US007118473B2

(12) United States Patent
Sung et al.

(10) Patent No.: US 7,118,473 B2
(45) Date of Patent: Oct. 10, 2006

(54) AIR VELOCITY CONTROL UNIT AND AIR CONDITIONING SYSTEM HAVING THE SAME

(75) Inventors: Woo-Dong Sung, Gyeonggi-do (KR); Dong-Hyun Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 139 days.

(21) Appl. No.: 10/804,972

(22) Filed: Mar. 19, 2004

(65) Prior Publication Data

US 2004/0185769 A1 Sep. 23, 2004

(30) Foreign Application Priority Data

Mar. 21, 2003 (KR) ..... 10-2003-0017833

(51) Int. Cl.
*F24F 7/00* (2006.01)

(52) U.S. Cl. ..... 454/187; 454/273

(58) Field of Classification Search ..... 454/187, 454/270, 273, 935

See application file for complete search history.

(56) References Cited

U.S. PATENT DOCUMENTS

| | | | | |
|---|---|---|---|---|
| 2,822,741 | A * | 2/1958 | Kennedy | 454/298 |
| 4,040,293 | A * | 8/1977 | Wilson | 73/861.61 |
| 4,061,082 | A * | 12/1977 | Shuler | 454/298 |
| 5,096,477 | A * | 3/1992 | Shinoda et al. | 55/385.2 |
| 5,520,580 | A * | 5/1996 | Showalter et al. | 454/273 |
| 5,830,058 | A * | 11/1998 | R.ø.sj.ø | 454/187 |
| 6,561,895 | B1 * | 5/2003 | McGill | 454/298 |

* cited by examiner

*Primary Examiner*—Derek S. Boles
(74) *Attorney, Agent, or Firm*—Marger Johnson & McCollom, P.C.

(57) ABSTRACT

An air velocity control unit includes first bars fixed using a frame. Second bars are disposed below the first bars. The second bars are alternatively arranged between the first bars. The second bars are connected with each other. The unit further includes a control member for moving the second bars upwardly and downwardly to control the air velocity. A connecting member connects the second bars to the control member. Clean air flows into a clean room by a controllable velocity in accordance with the upward and downward movement of the second bars.

20 Claims, 6 Drawing Sheets

AIR VELOCITY CONTROL UNIT AND AIR CONDITIONING SYSTEM HAVING THE SAME

CROSS REFERENCE TO RELATED APPLICATION

This application claims priority under 35 USC § 119 to Korean Patent Application 2003-17833 filed on Mar. 21, 2003, the contents of which are herein incorporated by reference in their entirety for all purposes.

BACKGROUND OF THE INVENTION

1. Field of the Invention

The present invention relates to an air velocity control unit and an air conditioning system including the air velocity control unit. More particularly, the present invention relates to an air velocity control unit for controlling the velocity of clean air released from an air filter disposed in a clean room, and an air conditioning system including the air velocity control unit.

2. Description of the Related Art

Generally, electronic parts including semiconductor devices are fabricated in a clean room that may be maintained at a constant temperature, humidity and pressure. The clean room may be controlled on a clean level with limited floating particles in air.

The clean room includes various kinds of air filters disposed in an air circulation chamber. The air filters remove airborne particles or an airborne molecular contamination (AMC) contained in the air, thereby creating a filtered laminar flow of air. The contaminant level in the clean room is controlled to a great extent by the cleanliness of the laminar air flow.

A bay of the clean room is divided into a process area and a working area. The process area and the working area have different cleanliness levels. The amount of the air-flows handled by the air filter and the filtering efficiency of the air filter are controlled according to the different cleanliness level in the respective process and working areas so that the final contaminant level of the clean room is determined.

Referring to FIG. 1A, a clean room of a process line is divided into a filter zone 15 including a process area 10 and a working area 12, and service zone 14. Each of the respective areas of the filter zone 15 is provided according to a predetermined cleanliness level of the clean room and an incoming air velocity. The clean room is divided into a low clean area and a high clean area. This is accomplished by providing air filters having different filtering efficiencies and air velocities to the respective areas. This separation into respective low and high clean areas facilitates the suppression of the diffusion of contaminants created by the particles in the air flow emitted into the clean room.

For example, an air filter, which removes about 99.9999% of particles having a size of about 0.1 μm and releases air having a velocity of above 0.4 m/s, may be provided to the process area 10 that requires high clean level, and which is represented as a class 1 location. An air filter, which removes about 99.9999% of particles having a size of about 0.1 μm and releases air having a velocity of above 0.25 m/s, may be provided to the working area 12 that requires a intermediate clean level, and which is represented as a class 10 location. An air filter, which removes about 99.9999% of particles having a size of about 0.1 μm and releases air having a velocity of above 0.35 m/s, is provided to the service zone 14 that requires a low clean level, and which is represented as a class 1,000 location.

The filtering efficiency of the air filter is related to maintaining the clean level of the process line in which semiconductor devices are fabricated. The velocity of air released from the air filter is controlled so that particle restricted zones are formed in the respective areas.

However, as time passes, it may become necessary for the filter zone 15 to be changed because of the introduction of new fabrication equipment. As shown in FIG. 1B, this results in the formation of a new area 16. An air filter is additionally installed for use within the area 16. Also, the number of air filters provided to the area 16 is often a substantial number. In order to install additional air filters, or to change the air filter that has been installed, the fabricating process or the operation of the clean room has to be suspended. As a result, this suspension of the fabrication process brings about significant stoppage of research, development and production of the semiconductor devices resulting in the significant loss of the time and money. Also, there is an additional cost due to continuous replacement of the air filters in the clean room.

Furthermore, the change in the clean room environment due to the enlargement of the clean room areas may be difficult to control, and the velocity of the air being released and the temperature in local zones may be hard to control as well. Thus, the level of cleanliness will in turn decrease. For example, when the air filter rapidly releasing air is installed as part of the new equipment, clean air passing through the air filter will collide with the new equipment and turbulent air will be formed. This turbulent air disturbs the laminar flow of downward air that will decrease the cleanliness level in the area.

A typical air conditioning system in a clean room controls the releasing velocity of air by manually operating the flow of the air entering into the clean room. The air conditioning system includes a first flat plate having an opening therein, a second flat plate translationally moving relative to the first flat plate and having an opening therein, and a third flat plate interposed between the first and second flat plates to restrict air flow between the first and second flat plates, respectively. The openings are selectively opened or closed by moving the second flat plate relative to the first flat plate so that the velocity of air entering into the clean room can be controlled.

However, since the area of the opening is limited to less than 30% of the total area of the first or second plate, the pressure loss of air may increase. Furthermore, since the friction resistance of air increases due to vibrations of the plates, particles may be generated from abrasion of the plates.

SUMMARY OF THE INVENTION

It is a first feature of the invention to provide an air velocity control unit for readily controlling velocity of air that flows into a clean room.

It is a second feature of the invention to provide an air conditioning system for readily controlling releasing velocity of air that flows into a clean room.

In accordance with one aspect of the present invention, an air velocity control unit according to one exemplary embodiment of the invention includes first bars fixed using a frame. Second bars are disposed below the first bars. The second bars are alternatively arranged between the first bars. The second bars are connected with each other. A control member moves the second bars upwardly and downwardly to control the velocity of air. A connecting member connects the second bars to the control member.

According to another exemplary embodiment of the invention, an air velocity control unit includes a frame, first bars fixed within the frame. Second bars are disposed above the first bars. The second bars are alternatively arranged between the first bars. The second bars are connected with each other. A control member moves the second bars upwardly and downwardly to control the velocity of air. A connecting member connects the second bars to the control member.

In accordance with a second aspect of the present invention, an air conditioning system according to one embodiment of the invention includes an air filter filtering an air entered into a clean room. An air velocity control unit is installed on the air filter to control the velocity of air released from the air filter. The air velocity control unit includes first bars fixed to a frame. Second bars are disposed below the first bars. The second bars are alternatively arranged between the first bars. The second bars are connected with each other. A control member moves the second bars upwardly and downwardly to control the velocity of air. A connecting member connects the second bars to the control member.

According to another embodiment of the invention, an air conditioning system includes an air filter for filtering air entered into a clean room. An air velocity control unit is installed on the air filter to control the velocity of air released from the air filter. The air velocity control unit includes first bars fixed to a frame. Second bars are disposed above the first bars. The second bars are alternatively arranged between the first bars. The second bars are connected with each other. A control member moves the second bars upwardly and downwardly to control the velocity of air. A connecting member connects the second bars to the control member.

According to the invention, the air velocity control unit installed on the air filter may control the velocity of an air released from the air filter. Since the air velocity control unit controls the releasing velocity of an air regardless of the efficiency of the air filter, the layout of the air filter may be flexibly changed so that cost concerning new equipment may be reduced.

BRIEF DESCRIPTION OF THE DRAWINGS

The above and other features and advantages of the present invention will become readily apparent by reference to the following detailed description when considered in conjunction with the accompanying drawings below.

DESCRIPTION OF THE PREFERRED EMBODIMENTS

Figure 1A:
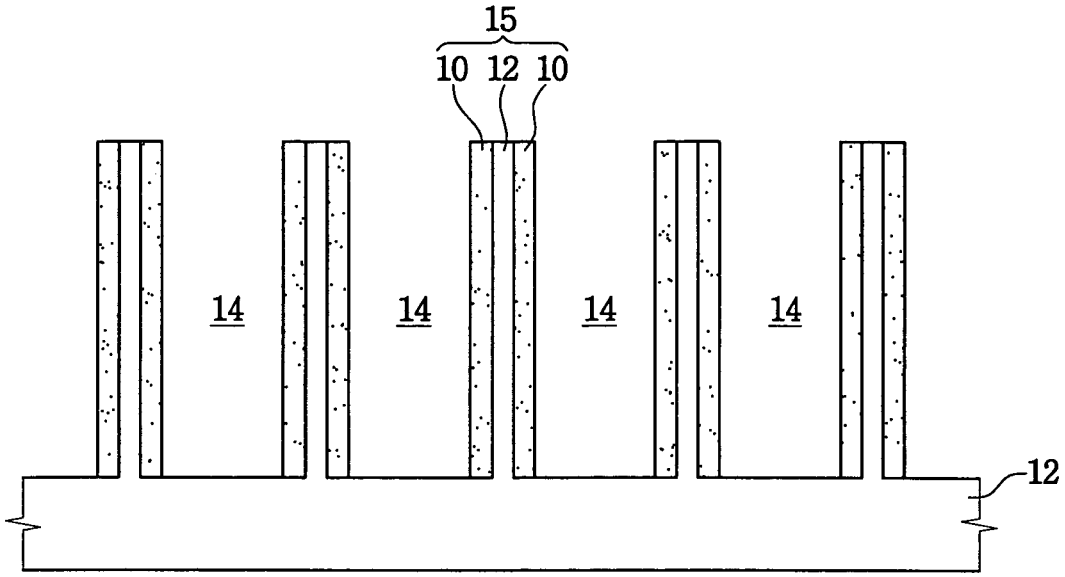
FIG. 1A is a layout view illustrating a filter zone and a service zone of a fabrication line when the process line is initially constructed.
Figure 1B:
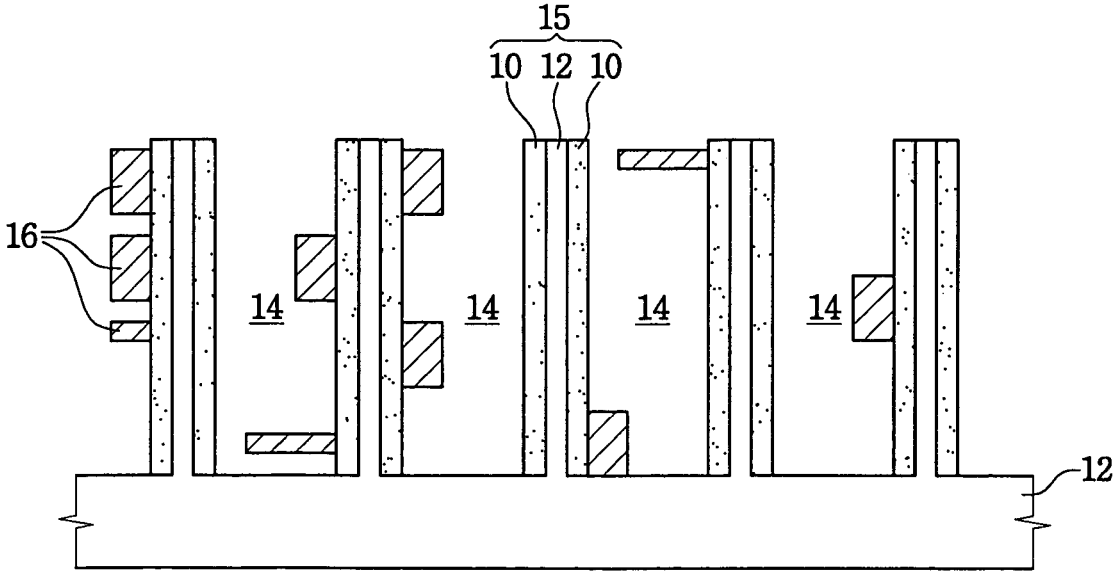
FIG. 1B is a layout view illustrating a filter zone and a service zone of a fabrication line after the process line is constructed.
Figure 2:
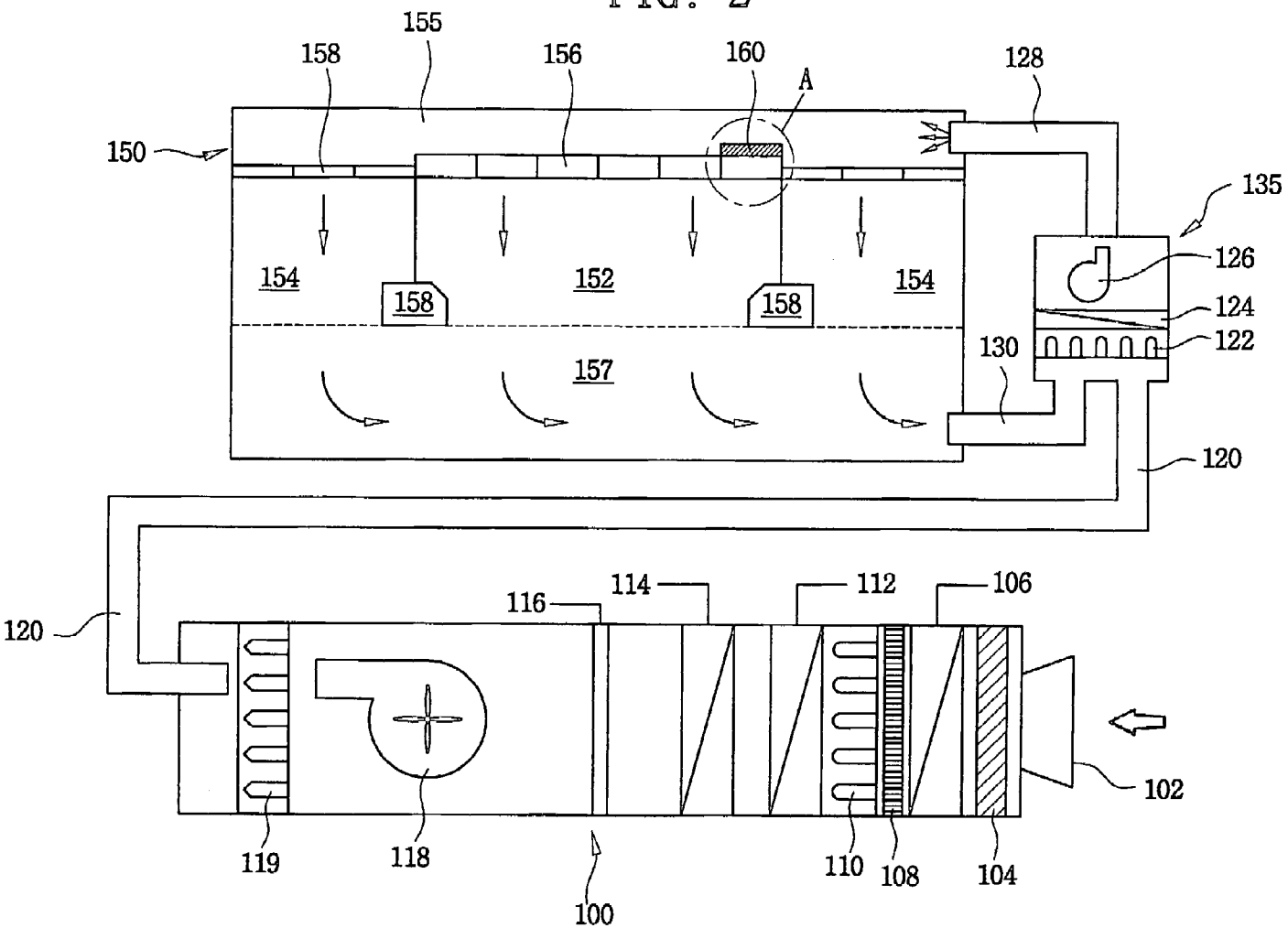
FIG. 2 is a front view illustrating an air conditioning system according to an exemplary embodiment of the present invention.

Referring to FIG. 2, an air conditioning system for a clean room according to the invention includes an external air conditioning unit 100, a circulation air conditioning unit 135, a plurality of air filters 156 and 158 (clean room filters), and an air velocity control unit 160.

A clean room 150 includes ceiling 155 through which an external air is introduced, a bay 152 including manufacturing equipments disposed thereon, a service area 154, and a plenum 157 (a space provided under the clean room) which releases clean air.

The bay 152 includes a processing area and a working area. The air filter 156, having high capability such as an ultra low pneumatic air (ULPA) filter or a high efficiency particulate air (HEPA) filter, is provided in the processing area that requires high cleanliness level, a class 1 location. The air filter 158, provided in the service area 154 requires a low cleanliness level, a class 1,000 location. The air filter 158 removes about 99.9999% of particles having size of about 0.1 μm, and releases an air flow at a velocity of above about 0.35 m/s.

The external air conditioning unit 100 is disposed at the outside of the clean room 150. The external conditioning unit 100 includes a housing having an inlet 102 and an outlet 120. Between the inlet 102 and the outlet 120 of the housing, a demister 104, a pre-heating coil 106, a pre-filter 108, a back filter 110, a cooling coil 112, a heating coil 114, a humidifier 116, a fan 118, and a final filter 119 having high capability are disposed.

The pre-filter 108 filters large particles, for example, large fabric particles, contained in the air passing through the inlet 102. A substantially entire front face of the back filter 110 filters the particles so that it has a relatively high filtering efficiency.

The circulation air conditioning unit 135 is connected to the plenum 157. The circulation air conditioning unit 135 receives and cools the clean air in the clean room 150. The circulation air conditioning unit 135 removes impurities contained in the air of the clean room 150, and then provides the clean air without the impurities thereto. The circulation air conditioning unit 135 includes a back filter 122, a cooling coil 124 and a fan 126.

The air velocity control unit 160 controls separately or entirely the velocity of the clean air released from the air filter 156. The air velocity control unit 160 may be provided to the all air filter 156 disposed on the bay 152, or may be provided partially to the air filter disposed in an only particular area, for example, the processing area. Alternatively, the air filters in the clean room 150 may be replaced with processing filters that requires the high clean level so that the air velocity control unit 160 may be provided to the processing filters. Here, initial cost for constructing the processing filters may increase due to high price of the processing filters. However, since changing the processing filters may be rare, a layout of the filters is almost maintained as it is, thereby lowering additional cost.

Figure 3:
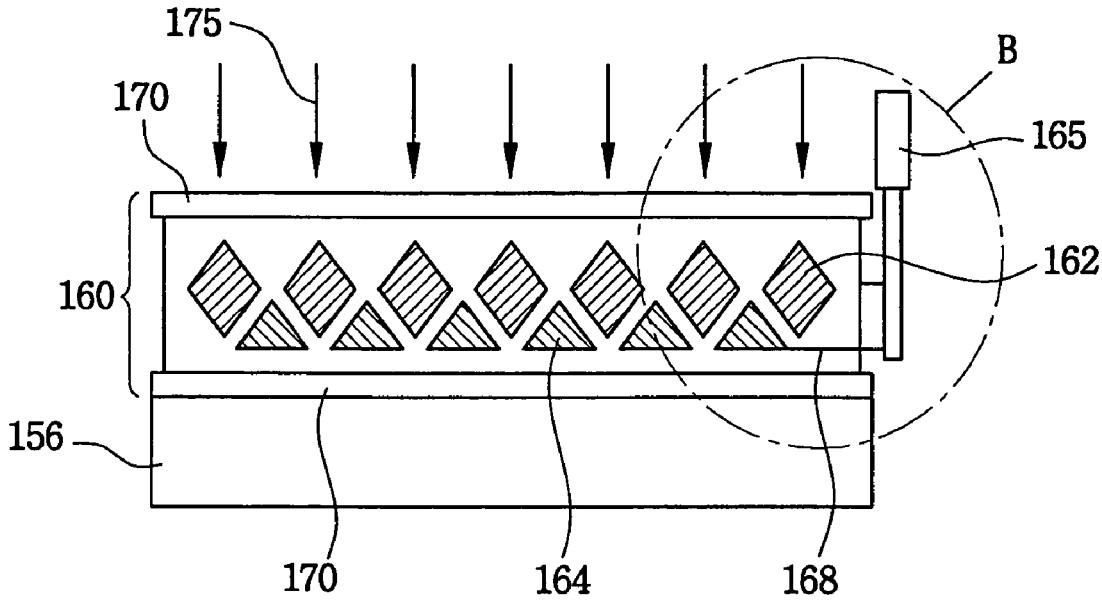
FIG. 3 is an enlarged cross-sectional view of a portion 'A' in FIG. 2 illustrating an air velocity control unit according to one embodiment of the invention.
Figure 4:
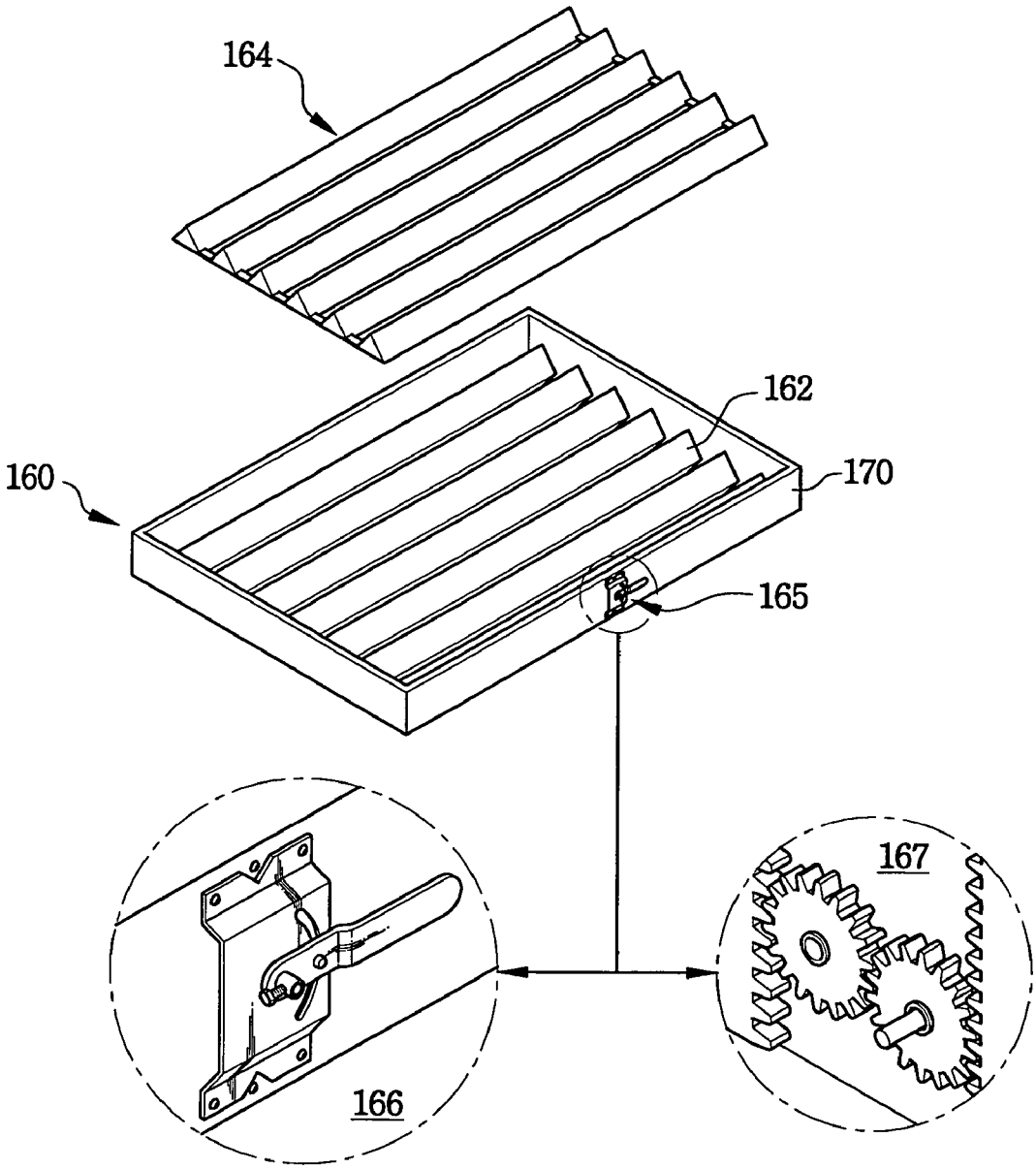
FIG. 4 is a perspective view illustrating the air velocity control unit according to one embodiment of the invention.

FIG. 3 illustrates an air velocity control unit according to one embodiment of the invention. FIG. 4 is a perspective view illustrating the air velocity control unit according to one embodiment of the invention. In FIG. 3, reference numeral 175 represents the flow of an air.

Referring to FIGS. 3 and 4, the air velocity control unit 160 of this embodiment includes first bars 162 fixed to a frame 170. Second bars 164 are disposed below the first bars 162. The second bars 164 are alternatively arranged between the first bars 162. The second bars 164 are connected with each other. A control member 165 moves the second bars 164 in upward and downward directions to control the velocity of the air. A connecting member 168 connects the second bars 164 to the control member 165.

The control member 165 includes a handle 166 for precisely controlling the velocity of the air, and gears 167 for transmitting driving power from the handle 166 to the second bars 164. The handle 165 may be manually controlled by an interval of about 10 mm to prevent an accident caused by an electric leakage. This manual control may reduce the mis-operation and mechanical breakage of the air velocity control unit 160. The manual control may also facilitate the installation and removal of the air velocity control unit 160.

To manually operate the control member 165, a worker may directly manipulate the control member 165 on the air velocity control unit 160. Accordingly, the first bars 162 are preferably made of a material such as aluminum that can sustain the load applied to the first bars 162. The first bars 162 are preferably made of another material such as stainless steel or plastic. More preferably, the air velocity control unit 160 is made of aluminum.

Since the air velocity control unit 160 is positioned beneath the ceiling 155 of the clean room 150, the air velocity control unit 160 may have maximum height of less than about 150 mm and total weight of less than about 20 kg.

The first bars 162 and the second bars 164 may have cross-sectional shapes which are configured as a lozenge, triangle, ellipse or circle. In this embodiment, the first bars 162 have a lozenge-shaped section whereas the second bars 164 have a triangular section. Alternatively, to prevent the first bars 162 and the second bars 164 from vibrating caused by the frictional resistance of the air, the first bars 162 and the second bars 164 may have elliptic sections, respectively.

The air velocity control unit 160 may have a transparent window (not shown) formed on a side of the frame 170 for inspecting the upward and/or downward motions of the second bars 164, or for acknowledging the controlled velocity of the air. In addition, the air velocity control unit 160 may include a manometer that indicates the pressure differences between the internal and the external atmosphere of the air velocity control unit 160. The air velocity control unit 160 may have an air velocity sensor that measures the velocity of the air in the air velocity control unit 160.

Figure 5A:
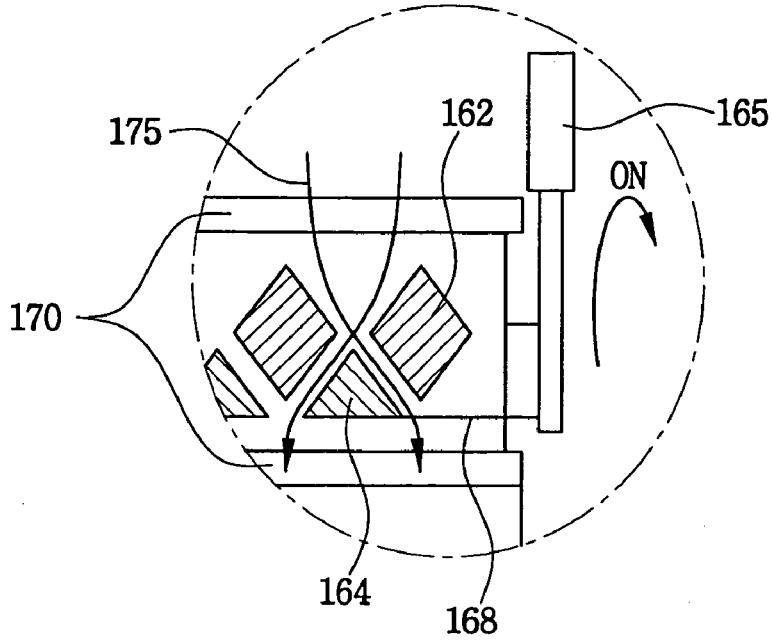
FIGS. 5A and 5B are enlarged views of a portion 'B' in FIG. 3 for illustrating operations of the air velocity control unit according to one embodiment of the invention.
Figure 5B:
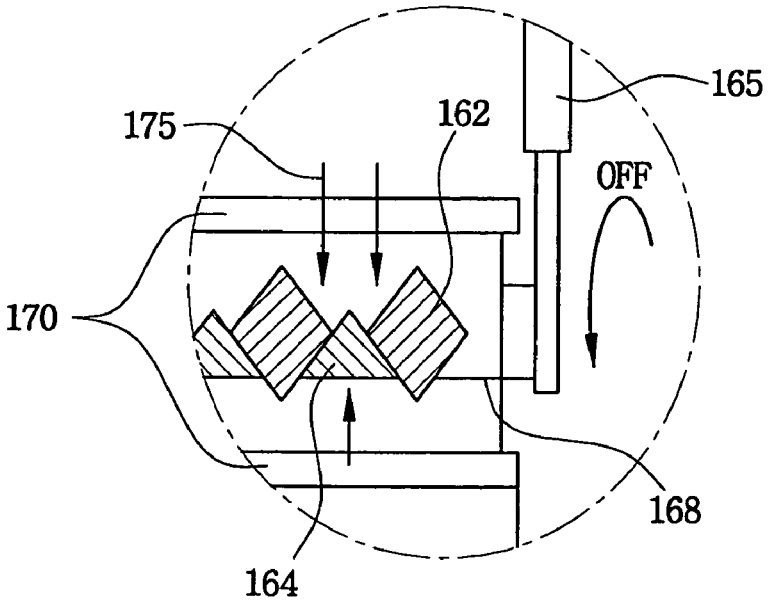

FIGS. 5A and 5B are enlarged views of a portion 'B' in FIG. 3 for illustrating operations of the air velocity control unit according to one embodiment of the invention. The external air conditioning unit 100 removes dust contained in the external air. The external air conditioning unit 100 also cools and dehumidifies the external air. The circulation air conditioning unit 135 removes contaminants contained in the cooled and humidified external air to generate clean air. The clean air is discharged through a supplying pipe 128.

The clean air flows in the ceiling 155 of the clean room 150. The clean air flows downwardly into the clean room 150 through the air velocity control unit 160 and the air filters 156 and 158. Particularly, as shown in FIG. 5A, when the control member 165 is turned on, the second bars 164 move downwardly so that passages are formed between the first bars 162 and the second bars 164. The clean air flowing through the ceiling 155 of the clean room 150 flows downwardly at a velocity of about 0.45 m/s into the clean room 150 via the air filter 156. When a particular area requires a high clean level due to introducing new equipments, the air velocity control unit 160 opens the passages between the first and second bars 162 and 164 to thereby increase the amounts of the air released from the air filter. As a result, the desired high clean level may be obtained.

On the other hand, as shown in FIG. 5B, when the control member 165 is turned off, the second bars 164 move upwardly so that the passages are closed. The velocity of the air passing through the air filter 156 can be about 0 m/s when the passages are closed. Thus, when the high clean area is changed into the low clean area, the amounts of air released from the air filter may be optimized by adjusting the passages using the air velocity control unit 160.

As described above, the second bars 164 move upwardly and downwardly so that the velocity of the air released from the air filter 156 can be optimally controlled. Accordingly, when new equipments are introduced, the desired releasing velocity of the air is obtained by only operating the air velocity control unit 160 without the use of any additional equipment or without varying the air filter being employed.

Figure 6:
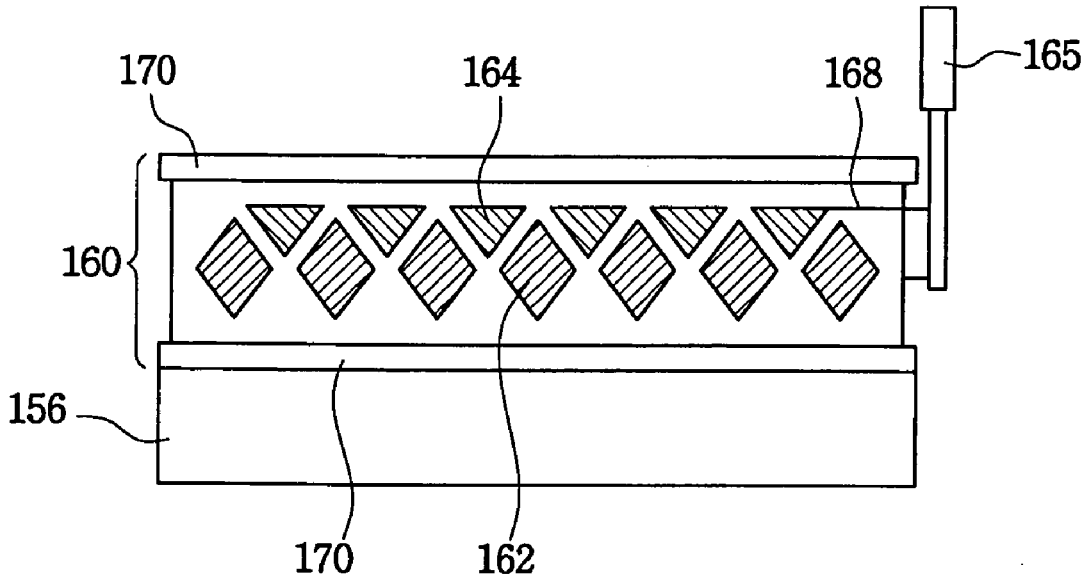
FIG. 6 is a cross sectional view illustrating an air velocity control unit according to another embodiment of the invention.

FIG. 6 is a cross-sectional view illustrating an air velocity control unit according to another embodiment of the invention. The air velocity control unit of FIG. 6 has a structure substantially identical to that of the air velocity control unit in FIG. 3. Referring to FIG. 6, the air velocity control unit 160 of this embodiment includes the first bars 162 fixed to a frame 170. The second bars 164 are disposed above the first bars 162. The second bars 164 are alternatively arranged between the first bars 162. The second bars 164 are connected with each other. The control member 165 moves second bars 164 in upwardly and downwardly to control the velocity of the air. The connecting member 168 connects the second bars 164 to the control member 165. The air velocity control unit 160 is preferably made of aluminum.

The control member 165 includes the handle 166 for precisely controlling the velocity of the air, and gears 167 for transmitting driving power from the handle 166 to the second bars 164.

The first bars 162 and the second bars 164 may have cross-sectional shapes, for example, they may be in the form of a lozenge, triangle, ellipse or circle. In this embodiment, the first bars 162 have a lozenge-shaped section, and the second bars 164 have a triangular section. Alternatively, to prevent the first bars 162 and the second bars 164 from vibrating caused by the friction resistance of the air, the first bars 162 and the second bars 164 may have the elliptic sections, respectively.

The air velocity control unit 160 may have a transparent window (not shown) formed on a side of the frame 170 for inspecting upward and/or downward motions of the second bars 164 or for acknowledging the controlled velocity of the air. Additionally, the air velocity control unit 160 may have a manometer indicating the pressure differences between the internal and the external of the air velocity control unit 160. The air velocity control unit 160 may have an air velocity sensor measuring the velocity of the air in the air velocity control unit 160.

According to the present invention, an air velocity control unit for controlling the speed of the air released from an air filter is installed thereon. Therefore, the air velocity control unit can control the releasing velocity of the air regardless of the capability of the air filter.

In addition, the air velocity control unit may partially control the released amounts of the air. Alternatively, the handle of the air velocity control unit may be manually operated or be remotely operated by an automatic unit, such as, for example, a motor. Furthermore, the air velocity control unit may efficiently control the pressure differences among divided areas.

Having described the preferred embodiments of the invention, it is noted that modifications and variations can be made by persons skilled in the art in light of the above teachings. It is therefore to be understood that changes may be made in the particular embodiment of the present invention disclosed which is within the scope and the spirit of the invention outlined by the appended claims.

What is claimed is:

1. An air velocity control unit comprising:

a frame;

first bars affixed within the frame;

second bars disposed below the first bars and arranged alternatively between the first bars, the second bars being connected with each other;

a control member for moving the second bars upwardly and downwardly to control air velocity flowing between the first and second bars into a clean room;

a connecting member for connecting the second bars to the control member; and a window formed on a side of the frame for inspecting upward and downward movement of the second bars and for displaying the adjusted value of the air velocity flow.

2. The air velocity control unit of claim 1, wherein either one or both of the first and second bars have a cross-sectional shape selected from the group consisting of a lozenge, a triangle, an ellipse and a circle.

3. The air velocity control unit of claim 1, wherein the control member comprises a handle for controlling upward and downward movement of the second bars and a gear for transmitting electric power to the handle.

4. The air velocity control unit of claim 1, wherein the control member is made of a material selected from the group consisting of aluminum, steel and plastic.

5. The air velocity control unit of claim 1, which controls the air velocity in a clean room, said unit further comprising a manometer for measuring pressure differences between an internal area and an external area of the clean room.

6. An air velocity control unit comprising:

a plurality of first bars disposed in a fixed position;

second bars disposed above the first bars and arranged alternatively between the first bars, the second bars being connected with each other;

a control member for moving the second bars upwardly and downwardly to a plurality of positions with respect to said first bars for controlling air velocity flowing between the first and second bars into a clean room;

a connecting member for connecting the second bars to the control member; and a window formed on a side of the frame for displaying the adjusted value of the air velocit flow.

7. The air velocity control unit of claim 6, wherein either one of the first and second bars have a cross-sectional shape selected from the group consisting of a lozenge, a triangle, an ellipse and a circle.

8. The air velocity control unit of claim 6, wherein the control member comprises a handle for controlling upward and downward movement of the second bars.

9. The air velocity control unit of claim 6, which controls the air velocity in a clean room, said unit further comprising a manometer for measuring pressure differences between an internal area and an external area of the clean room.

10. An air velocity control unit comprising:

a plurality of first bars disposed in a fixed position;

second bars disposed above the first bars and arranged alternatively between the first bars, the second bars being connected with each other;

a control member for moving the second bars upwardly and downwardly to a plurality of positions with respect to said first bars for controlling air velocity flowing between the first and second bars into a clean room;

a connecting member for connecting the second bars to the control member; and a window formed on a side of the frame for inspecting the upward and downward movement of the second bars.

11. An air conditioning system comprising:

an air filter for filtering air flowing into a clean room;

an air velocity control unit installed on the air filter for controlling a velocity of air released from the air filter; and a window formed on a side of the frame for inspecting upward and downward movement of the second bars and for displaying adjusted value of the air velocity flow, wherein the air velocity control unit comprises a) a frame, b) first bars affixed within said frame, c) second bars disposed below the first bars and arranged alternatively between the first bars, the second bars being connected with each other, d) a control member for moving the second bars upwardly and downwardly to control air velocity flowing between the first and second bars into the clean room, and e) a connecting member for connecting the second bars to the control member.

12. The air conditioning system of claim 11, wherein the air filter comprises a low efficiency particulate air filter, an intermediate efficiency particulate air filter or a high efficiency particulate air filter.

13. The air conditioning system of claim 11, wherein either one or both of he first and second bars have a cross-sectional shape selected from the group consisting of a lozenge, a triangle, an ellipse and a circle.

14. The air conditioning system of claim 11, wherein the control member comprises a handle for controlling upward and downward movement of the second bars and a gear for transmitting electric power to the handle.

15. The air velocity control unit of claim 11, wherein the control member has a shape selected from the group consisting of aluminum, steel and plastic.

16. The air conditioning system of claim 11, which controls the air velocity in a clean room, said unit further comprising a manometer for measuring pressure differences between an internal area and an external area of the clean room.

17. An air conditioning system comprising:

an air filter for filtering an air flowing into a clean room; and an air velocity control unit installed on the air filter for controlling a velocity of an air released from the air filter, wherein the air velocity control unit comprises a) a frame, b) first bars affixed within said frame, c) second bars disposed above the first bars and arranged alternatively between the first bars, the second bars being connected with each other, d) a control member for moving the second bars upwardly and downwardly to control the air velocity of flowing through between the first and second bars into a clean room, and e) a connecting member for connecting the second bars to the control member; and a window formed on a side of the frame for inspecting the upward and downward movement of the second bars.

18. The air conditioning system of claim 17, wherein the air filter comprises a low efficiency particulate air filter, an intermediate efficiency particulate air filter or a high efficiency particulate air filter.

19. The air conditioning system of claim 17, wherein either one or both of he first and second bars have a cross-sectional shape selected from the group consisting of a lozenge, a triangle, an ellipse and a circle.

20. The air conditioning system of claim 17, wherein the control member comprises a handle for controlling upward and downward movement of the second bars.

* * * * *

UNITED STATES PATENT AND TRADEMARK OFFICE

CERTIFICATE OF CORRECTION

PATENT NO. : 7,118,473 B2
APPLICATION NO. : 10/804972
DATED : October 10, 2006
INVENTOR(S) : Woo-Dong Sung et al.

It is certified that error appears in the above-identified patent and that said Letters Patent is hereby corrected as shown below:

Column 7, line 58, the word “velocit” should read -- velocity --;
Column 8, line 40, the word “he” should read -- the --;
Column 10, line 2, the word “he” should read -- the --.

Signed and Sealed this

Ninth Day of September, 2008

JON W. DUDAS
*Director of the United States Patent and Trademark Office*